US012709782B2

(12) United States Patent
Kobayashi et al.

(10) Patent No.: US 12,709,782 B2
(45) Date of Patent: Aug. 18, 2026

(54) FERRITIC STAINLESS STEEL SHEET AND PRODUCTION METHOD

(71) Applicant: NIPPON STEEL STAINLESS STEEL CORPORATION, Tokyo (JP)

(72) Inventors: Ryo Kobayashi, Tokyo (JP); Masaharu Hatano, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 376 days.

(21) Appl. No.: 18/037,344

(22) PCT Filed: Dec. 3, 2021

(86) PCT No.: PCT/JP2021/044399

§ 371 (c)(1),
(2) Date: May 17, 2023

(87) PCT Pub. No.: WO2022/124215

PCT Pub. Date: Jun. 16, 2022

(65) Prior Publication Data

US 2023/0407431 A1 Dec. 21, 2023

(30) Foreign Application Priority Data

Dec. 8, 2020 (JP) ..... 2020-203100

(51) Int. Cl.
*C21D 9/46* (2006.01)
*C21D 8/1216* (2026.01)
(Continued)

(52) U.S. Cl.
CPC ..... *C21D 9/46* (2013.01); *C21D 8/1233* (2013.01); *C21D 8/1272* (2013.01);
(Continued)

(58) Field of Classification Search
CPC ... C21D 1/26; C21D 1/74; C21D 1/76; C21D 2201/05; C21D 2211/005; C21D 6/002;
(Continued)

(56) References Cited

U.S. PATENT DOCUMENTS 5,601,664 A * 2/1997 Kosa ..... H01F 1/14766 148/307
12,270,096 B2 * 4/2025 Nishimura ..... C21D 6/002
(Continued)

FOREIGN PATENT DOCUMENTS

JP H 05-255817 10/1993
JP H062044 A * 1/1994
(Continued)

*Primary Examiner* — Rebecca Janssen
*Assistant Examiner* — Mayela Aldaz
(74) *Attorney, Agent, or Firm* — Birch, Stewart, Kolasch & Birch, LLP

(57) ABSTRACT

There is provided a ferritic stainless steel sheet including a magnetized area fraction of 50% or more wherein the ferritic stainless steel sheet chemical composition includes, in mass %: C: 0.015% or less, Si: 3.0% or less, Mn: 1.0% or less, S: 0.0040% or less, P: 0.08% or less, Al: 0.80% or less, N: 0.030% or less, Cr: 15.0 to 25.0%, Mo: 0.5 to 3.0%, Ti: 0 to 0.50%, Nb: 0 to 0.50%, Ni: 0 to 0.50%, Cu: 0% or more to less than 0.1%, Zr: 0 to 1.0%, V: 0 to 1.0%, REM: 0 to 0.05%, and B: 0 to 0.01%, with the balance: Fe and impurities, and satisfies Formula (i): $0.10 \leq Ti+Nb \leq 0.50$.

9 Claims, 1 Drawing Sheet

(51) Int. Cl.

| | |
|---|---|
| ***C21D 8/1244*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C21D 2201/05* (2013.01); *C21D 2211/005* (2013.01); *C22C 2202/02* (2013.01)

(58) Field of Classification Search
CPC .. C21D 8/1222; C21D 8/1233; C21D 8/1261; C21D 8/1272; C21D 9/46; C22C 2202/02; C22C 38/001; C22C 38/002; C22C 38/004; C22C 38/005; C22C 38/02; C22C 38/04; C22C 38/06; C22C 38/22; C22C 38/26; C22C 38/28; C22C 38/32; C22C 38/34; C22C 38/42; C22C 38/44; C22C 38/46; C22C 38/48; C22C 38/50
See application file for complete search history.

(56) References Cited

U.S. PATENT DOCUMENTS

| | | | | |
|---|---|---|---|---|
| 2015/0376732 | A1 * | 12/2015 | Hamada | C22C 38/54 148/610 |
| 2018/0237891 | A1 | 8/2018 | Hori et al. | |

FOREIGN PATENT DOCUMENTS

| | | | | | |
|---|---|---|---|---|---|
| JP | H06-136555 | A | | 5/1994 | |
| JP | H 08-120420 | | | 5/1996 | |
| JP | H 09-174114 | | | 7/1997 | |
| JP | 2000-064000 | | | 2/2000 | |
| JP | 2017-039955 | | | 2/2017 | |
| KR | 20200065964 | A | * | 6/2020 | C22C 38/42 |
| WO | 2014/119796 | | | 8/2014 | |

* cited by examiner

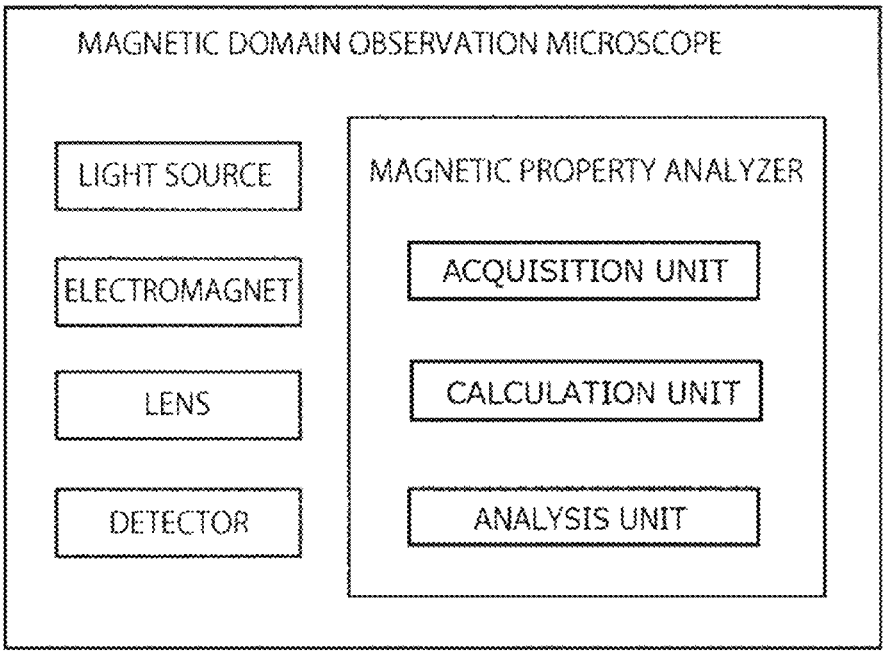
MAGNETIC DOMAIN OBSERVATION MICROSCOPE
LIGHT SOURCE
ELECTROMAGNET
LENS
DETECTOR
MAGNETIC PROPERTY ANALYZER
ACQUISITION UNIT
CALCULATION UNIT
ANALYSIS UNIT

FERRITIC STAINLESS STEEL SHEET AND PRODUCTION METHOD

TECHNICAL FIELD

The present invention relates to a ferritic stainless steel sheet and a production method.

BACKGROUND ART

For an electromagnetic valve, a magnetic head, various sensors, and the like in an electronic device, a soft magnetic material, which has a large magnetization and a high magnetic permeability and is capable of changing its magnetization in response to the direction and the magnitude of an external magnetic field, is used. As soft magnetic materials, for example, a Ni—Fe-based alloy called permalloy, an electrical steel sheet with Ni plating, and the like have been in widespread use.

In contrast, the soft magnetic material described above is high in its material cost because the soft magnetic material contains Ni in a large amount. Thus, the use of ferritic stainless steel, which is relatively inexpensive and satisfactory in corrosion resistance as the soft magnetic material, has been studied. For example, Patent Documents 1 and 2 disclose soft magnetic, ferritic stainless steel sheets having improved magnetic properties.

LIST OF PRIOR ART DOCUMENTS

Patent Document

Patent Document 1: JP8-120420A
Patent Document 2: JP5-255817A

SUMMARY OF INVENTION

Technical Problem

In recent years, there has been a need for reduction in size and weight of electronic devices. In addition, soft magnetism ferritic stainless steels used for electronic devices are required to have further improved magnetic properties, that is, further improved soft magnetic properties so as to satisfy the requirement.

However, ferritic stainless steels disclosed in Patent Documents 1 and 2 have room for consideration about soft magnetic properties and corrosion resistance.

In view of the above, an objective of the present invention is to solve the problem and provide a terrific stainless steel sheet that has satisfactory magnetic properties, more specifically, satisfactory soft magnetic properties, and satisfactory corrosion resistance.

Solution to Problem

The present invention is made to solve the problem described above, and the gist of the present invention is the following ferritic stainless steel sheet and production method.

(1) A ferritic stainless steel sheet including a magnetized area fraction of 50% or more.

(2) The ferritic stainless steel sheet according to (1) above, wherein a chemical composition includes, in mass %:

C: 0.015% or less,
Si: 3.0% or less,

Mn: 1.0% or less,
S: 0.0040% or less,
P: 0.08% or less,
Al: 0.80% or less,
N: 0.030% or less,
Cr: 15.0 to 25.0%,
Mo: 0.5 to 3.0%,
Ti: 0 to 0.50%,
Nb: 0 to 0.50%,
Ni: 0 to 0.50%,
Cu: 0% or more to less than 0.1%,
Zr: 0 to 1.0%,
V: 0 to 1.0%,
REM: 0 to 0.05%, and
B: 0 to 0.01%,
with the balance: Fe and impurities, and
satisfies Formula (i) shown below:

$$0.10 \leq Ti+Nb \leq 0.50 \quad \text{(i)}$$

where symbols of elements in the formula indicate contents (mass %) of the elements contained in the steel, and when an element is not contained, zero will be set to the corresponding symbol.

(3) The ferritic stainless steel sheet according to (2) above, wherein the chemical composition contains, in mass %:

Si: 0.60% or less.

(4) The ferritic stainless steel sheet according to (2) or (3) above, wherein the chemical composition contains one or more elements selected from, in mass %:

Ni: 0.05 to 0.50%,
Cu: 0.01% or more to less than 0.1%,
Zr: 0.01 to 1.0%,
V: 0.01 to 1.0%,
REM: 0.005 to 0.05%, and
B: 0.0002 to 0.01%.

(5) The ferritic stainless steel sheet according to any one of (1) to (4) above, wherein a pitting resistance equivalent number PREN that is calculated by Formula (ii) shown below is 20.0 or more, and in an RD-direction crystal orientation, F1 that is given by Formula (iii) shown below and is a ratio between a total area $S_{<001>}$ of grains having orientations parallel to a <001> direction and a total area $S_{<111>}$ of grains having orientations parallel to a <111> direction is 5.0 or more:

$$PREN=Cr+3.3Mo+16N \quad \text{(ii)}$$

$$F1=S_{<001>}/S_{<111>} \quad \text{(iii)}$$

where symbols of elements in Formula (ii) shown above indicate contents (mass %) of the elements contained in the steel, and when an element is not contained, zero will be set to the corresponding symbol.

(6) The ferritic stainless steel sheet according to any one of (1) to (5) above, wherein a maximum grain size of grains observed is 500 μm or more.

(7) A production method for producing the ferritic stainless steel sheet according to any one of (1) to (4) above, the method including:

a cold rolling step of performing cold rolling with rolls having a diameter of 100 mm or less at a cold rolling reduction rate of 75% or more; and a cold-rolled sheet annealing step of performing annealing after the cold rolling step.

(8) A production method for producing the ferritic stainless steel sheet according to (5) or (6) above, the method including:

a cold rolling step of performing cold rolling with rolls having a diameter of 90 mm or less at a cold rolling reduction rate of 80% or more; and a cold-rolled sheet annealing step of performing annealing after the cold rolling step.

(9) The production method according to (8) above for producing the ferritic stainless steel sheet according to (5) or (6) above, the method further including:

an adjustment annealing step of performing annealing for adjusting a crystal orientation one or more times after the cold-rolled sheet annealing step, wherein in the adjustment annealing step, an inert gas atmosphere or a vacuum atmosphere is used as an annealing atmosphere, an annealing temperature is set to within a range of more than 750° C. to 1350° C. or less, an annealing time is set to within a range of 4 hours or more, and a heating rate for reaching the annealing temperature is set to less than 30° C./min.

Advantageous Effects of Invention

According to the present invention, a ferritic stainless steel sheet having satisfactory magnetic properties, more specifically, satisfactory soft magnetic properties, and satisfactory corrosion resistance can be provided.

BRIEF DESCRIPTION OF DRAWINGS

The FIGURE is a diagram illustrating a schematic configuration of a magnetic domain observation microscope.

DESCRIPTION OF EMBODIMENTS

The present inventors conducted detailed studies about how to improve the soft magnetic properties of a ferritic stainless steel sheet and obtained the following findings (a) to (c).

(a) By increasing a content of Si, magnetic flux density can be increased, and the soft magnetic properties can be improved. At the same time, the increase of the content of Si may degrade workability, thus degrading producibility. It is therefore desirable to contain Cr and Ti, which are effective in improving the soft magnetic properties, while reducing the content of Si. In addition, the presence of Mo can improve corrosion resistance.

(b) For increasing the soft magnetic properties of the steel sheet, it is desirable to perform control in such a manner as to bring a magnetized area fraction that is observed under a magnetic domain observation microscope to 50% or more. To bring the magnetized area fraction to 50% or more, it is preferable to perform cold rolling with rolls having a diameter of 100 mm or less in such a manner that a cold rolling reduction rate is adjusted to 75% or more. As a result, as a texture of the steel sheet, a micro-structure in which, in a rolling direction (RD) plane orientation, its <001> orientation, which resists developing in a conventional process and is effective in improving the soft magnetic properties, develops can be provided.

(c) Note that, to produce a texture in which its <001> orientation further develops, it is preferable to perform, in addition to conventional annealing of a cold-rolled sheet, annealing for further adjusting the orientation (also referred to simply as "adjustment annealing") one or more times. In the adjustment annealing, it is preferable to set its annealing temperature to within the range of more than 750° C. to 1350° C. or less and set its annealing time to 4 hours or more. Further, it is preferable to reduce a heating rate for reaching the annealing temperature to less than 30° C./min. This causes the <001> orientation to develop more strongly. Further, this reduces the orientation of γ-fiber, which decreases the magnetized area fraction. As a result, the soft magnetic properties are improved.

An embodiment of the present invention has been made based on the above findings. Requirements of the present embodiment will be described below in detail.

1. Magnetized Area Fraction

Soft magnetic properties are properties that facilitate magnetization when a magnetic field is applied and facilitates demagnetization when the magnetic field is removed as described above. Criteria for evaluating magnetic properties include magnetic flux density. Although the magnetic flux density is an index that indicates the strength of a magnetic field, the evaluation of soft magnetic properties requires not simply the strength of a magnetic field but also the facilitation of magnetization and demagnetization.

Therefore, the ferritic stainless steel sheet in the present embodiment is made to have the magnetized area fraction described below that is brought to 50% or more. Further, by bringing the magnetized area fraction to 50% or more, not only the magnetic flux density but also the facilitation of magnetization and demagnetization is made satisfactory, which improves the soft magnetic properties. The magnetized area fraction can also increase the magnetic flux density because there is a satisfactory correlation between the magnetized area fraction and the magnetic flux density. To provide more satisfactory soft magnetic properties, the magnetized area fraction is preferably set to 70% or more, more preferably 80% or more, and still more preferably 90% or more. Note that no particular upper limit value is specified on the magnetized area fraction. The magnetized area fraction is 100% or less.

Here, the magnetized area fraction will be described. The magnetized area fraction is the proportion of a magnetized area to an area of an observation field in terms of percentage and is calculated by the magnetic properties analyzing method described in JP2021-162425A. In the magnetic properties analyzing method, for example, as illustrated in The FIGURE, a magnetic domain observation microscope including a light source, an electromagnet, a lens, a detector, and a magnetic property analyzer is used. The magnetic domain observation microscope is based on the effect in which incident light with linear polarization changes in polarization when the incident light is reflected by a magnetized sample surface, that is, the Kerr effect is utilized. The magnetic domain observation microscope detects reflection light from a surface produced by the Kerr effect. Specifically, there is a difference in contrast between before and after the application of a magnetic field. From the difference in this contrast, a magnetized area fraction is measured.

The magnetic domain observation microscope used for measuring the magnetized area fraction in the present application is Neomagnesia Lite from NEOARK Corporation, which includes a white LED as the light source and a Weiss electromagnet as the electromagnet. First, an amount of change in reflection light intensity is measured in the state where no magnetic field is applied to a sample, and a threshold for the amount of change in reflection light intensity with which 99% of an observation region is determined to be unmagnetized is specified. Next, with a magnetic field of 1000 Oe applied to the sample, a region having an amount of change in reflection light intensity exceeding the specified threshold is extracted as a magnetized region, and an area fraction of the magnetized region is calculated as the magnetized area fraction. The observation is performed in three visual fields with a magnification within the range of ×1000 to ×2500.

2. Chemical Composition

The following ranges are preferably set to a chemical composition of the ferritic stainless steel sheet in the present embodiment. Here, reasons for limiting a content of each element are as follows. In the following description, the symbol "%" for contents means "mass %".

C: 0.015% or Less

C (carbon) combines with other elements to form their carbides, degrading the soft magnetic properties. A content of C is therefore preferably set to 0.015% or less. More preferably, the content of C is set to 0.010% or less. Still more preferably, the content of C is set to 0.008% or less. Although the content of C is preferably minimized, excessive reduction of the content of C increases production costs. Thus, the content of C is preferably set to 0.001% or more.

Si: 3.0% or Less

Si (silicon) is an element that has deoxidation effect and improves the soft magnetic properties. However, if Si is contained excessively, the soft magnetic properties are rather degraded. In addition, workability is also degraded. Thus, a content of Si is preferably set to 3.0% or less. The content of Si is preferably set to 1.5% or less. For the steel sheet in the present embodiment, the content of Si is preferably reduced to increase the magnetized area fraction described later to 70% or more. Specifically, the content of Si is more preferably set to 0.60% or less. On the other hand, to provide the deoxidation effect, the content of Si is preferably set to 0.01% or more.

Mn: 1.0% or Less

Mn (manganese) has deoxidation effect and the effect of improving strength. However, if Mn is contained excessively, the soft magnetic properties are degraded. In addition, workability may be degraded. Thus, a content of Mn is preferably set to 1.0% or less. The content of Mn is more preferably set to 0.50% or less, and still more preferably set to 0.30% or less. On the other hand, excessive reduction of Mn increases production costs. Thus, the content of Mn is preferably set to 0.10% or more.

S: 0.0040% or Less

S (sulfur) is an impurity contained in the steel and degrades the soft magnetic properties. Thus, a content of S is preferably set to 0.0040% or less. More preferably, the content of S is set to 0.0020% or less. Although the content of S is preferably minimized, excessive reduction of the content of S increases production costs. Thus, the content of S is preferably set to 0.0001% or more.

P: 0.08% or Less

P (phosphorus) is an impurity contained in the steel and degrades the soft magnetic properties. Thus, a content of P is preferably set to 0.08% or less. More preferably, the content of P is set to 0.05% or less. Although the content of P is preferably minimized, excessive reduction of the content of P increases production costs. Thus, the content of P is preferably set to 0.005% or more.

Al: 0.80% or Less

Al (aluminum) is an element that has deoxidation effect. Al has the effect of improving the soft magnetic properties by reducing impurities with deoxidation. However, if Al is contained excessively, the soft magnetic properties are degraded. Thus, a content of Al is preferably set to 0.80% or less. The content of Al is more preferably set to 0.30% or less, and still more preferably set to 0.25% or less. On the other hand, to provide the effects, the content of Al is preferably set to 0.01% or more.

N: 0.030% or Less

N (nitrogen) may be contained as an impurity in the steel. N combines with other elements to form their nitrides, degrading the soft magnetic properties and cold workability. Thus, a content of N is preferably set to 0.030% or less. More preferably, the content of N is set to 0.020% or less. Although the content of N is preferably minimized, excessive reduction of the content of N increases production costs. Thus, the content of N is preferably set to 0.005% or more.

Cr: 15.0 to 25.0%

Cr (chromium) has the effect of improving corrosion resistance. Cr is a ferrite foil ling element, thus having the effect of improving the soft magnetic properties. In particular, when Si is reduced, the soft magnetic properties may be degraded. In this case, a content of Cr is desirably increased. Thus, the content of Cr is preferably set to or more, and more preferably set to 16.0% or more. However, if Cr is contained excessively, the soft magnetic properties are rather degraded. Thus, the content of Cr is preferably set to 25.0% or less, more preferably set to 20.0% or less, and still more preferably set to 18.5% or less.

Mo: 0.5 to 3.0%

Mo (molybdenum) has the effect of improving corrosion resistance. Mo is a ferrite stabilizing element, thus having the effect of improving the soft magnetic properties. In particular, when Si is reduced, the soft magnetic properties may be degraded. Therefore, as with Cr, a content of Mo is desirably increased. Thus, the content of Mo is preferably set to 0.5% or more, and more preferably set to 1.0% or more. However, if Mo is contained excessively, its cost is increased, and additionally, the soft magnetic properties are degraded. Thus, the content of Mo is preferably set to 3.0% or less, more preferably set to 2.0% or less, and still more preferably set to 1.6% or less.

In addition to the elements described above, one or more elements selected from Ti, Nb, Ni, Cu, Zr, V, REM, and B may be contained within their respective ranges described below. Reasons for limiting a content of each element will be described.

Ti: 0 to 0.50%

Ti (titanium) has the effect of improving corrosion resistance and workability. Further, Ti has the effect of preventing the production of martensite phases, which degrade the soft magnetic properties, thus contributing to the improvement in the soft magnetic properties. It is therefore preferable that Ti is contained together with Nb, which has the same effect, or Ti is contained without Nb, as necessary. However, if Ti is contained excessively, workability is decreased. Thus, a content of Ti is preferably set to 0.50% or less. The content of Ti preferably satisfies Formula (i) described later.

Nb: 0 to 0.50%

Nb (niobium) has, as with Ti, the effect of improving corrosion resistance and workability. Further, Nb has the effect of preventing the production of martensite phases, which degrade the soft magnetic properties, thus improving the soft magnetic properties. It is therefore preferable that Nb is contained together with Ti, which has the same effect, or Nb is contained without Ti, as necessary. However, if Nb is contained excessively, workability is decreased. Thus, a content of Nb is preferably set to 0.50% or less. The content of Nb preferably satisfies Formula (i) described later.

Here, the content of Ti and the content of Nb preferably satisfy Formula (i) shown below:

$$0.10 \leq Ti+Nb \leq 0.50 \quad (i)$$

where symbols of elements in the formula indicate contents (mass %) of the elements contained in the steel, and when an element is not contained, zero will be set to the corresponding symbol.

If the middle value of Formula (i), which is the total content of Ti and Nb, is less than 0.10%, it becomes difficult to provide the advantageous effect of improving corrosion resistance, workability, and the soft magnetic properties described above. Thus, the middle value of Formula (i) is preferably set to 0.10% or more. More preferably, the middle value of Formula (i) is set to 0.20% or more. However, if the middle value of Formula (i) is more than 0.50%, workability is likely to be degraded. Therefore, the middle value of Formula (i) is preferably set to 0.50% or less. More preferably, the middle value of Formula (i) is set to 0.40% or less.

Ni: 0 to 0.50%

Ni (nickel) has the effect of improving corrosion resistance and toughness. Thus, Ni may be contained as necessary. However, if Ni is contained excessively, the soft magnetic properties are degraded. Thus, a content of Ni is preferably set to 0.50% or less, more preferably set to 0.40% or less. On the other hand, to provide the effects, the content of Ni is preferably set to 0.05% or more.

Cu: 0% or More to Less than 0.1%

Cu (copper) has the effect of improving corrosion resistance. Thus, Cu may be contained as necessary. However, if Cu is contained excessively, workability is decreased. Further, production costs are increased as well. Thus, a content of Cu is preferably set to less than 0.1%, more preferably set to 0.05% or less. On the other hand, to provide the effect, the content of Cu is preferably set to 0.01% or more.

Zr: 0 to 1.0%

Zr (zirconium) has the effect of improving toughness and cold forgeability. Thus, Zr may be contained as necessary. However, if Zr is contained excessively, the soft magnetic properties are degraded. Thus, a content of Zr is preferably set to 1.0% or less, more preferably set to 0.5% or less. On the other hand, to provide the effect, the content of Zr is preferably set to 0.01% or more.

V: 0 to 1.0%

V (vanadium) has the effect of improving toughness and cold forgeability. Thus, V may be contained as necessary. However, if V is contained excessively, the degradation of the soft magnetic properties occurs. Thus, a content of V is preferably set to 1.0% or less, more preferably set to 0.5% or less. On the other hand, to provide the effect, the content of V is preferably set to 0.01% or more.

REM: 0 to 0.05%

REM (rare earth metal) acts as a deoxidizing element, thus having the effect of reducing impurities. Thus, REM may be contained as necessary. However, if REM is contained excessively, the degradation of the soft magnetic properties occurs. Thus, a content of REM is preferably set to 0.05% or less, more preferably set to 0.03% or less. On the other hand, to provide the effect, the content of REM is preferably set to 0.005% or more.

B: 0 to 0.01%

B (boron) has the effect of improving the soft magnetic properties and workability. Thus, B may be contained as necessary. However, if B is contained excessively, the soft magnetic properties are degraded. Thus, a content of B is preferably set to 0.01% or less, more preferably set to 0.005% or less. On the other hand, to provide the effect, the content of B is preferably set to 0.0002% or more.

Pitting Resistance Equivalent Number

Here, in the chemical composition of the ferritic stainless steel sheet in the present embodiment, the pitting resistance equivalent number PREN given by Formula (ii) shown below is preferably 20.0 or more. This is for providing a desired corrosion resistance. To provide more satisfactory corrosion resistance, the pitting resistance equivalent number (PREN) is more preferably 22.0 or more.

$$PREN=Cr+3.3Mo+16N \quad (ii)$$

where symbols of elements in Formula (ii) shown above indicate contents (mass %) of the elements contained in the steel, and when an element is not contained, zero will be set to the corresponding symbol.

In the chemical composition of the steel sheet in the present embodiment, the balance is preferably Fe and impurities. The term "impurities" herein means components that are mixed in steel in producing the steel industrially from raw materials such as ores and scraps and due to various factors in the producing process, and are allowed to be mixed in the steel within their respective ranges in which the impurities have no adverse effect on the present embodiment.

3. Crystal Orientation

For the ferritic stainless steel sheet according to the present embodiment, it is desirable to make the <001> orientation develop, which is effective in improving the soft magnetic properties but usually resists developing. Therefore, as shown below, it is preferable to set F1 given by Formula (iii) shown below, which is the ratio between a total area $S_{<001>}$ of grains having orientations parallel to the <001> direction and a total area $S_{<111>}$ of grains having orientations parallel to the <111> direction, to 5.0 or more in an RD-direction crystal orientation. Note that RD is an abbreviation of Rolling Direction, meaning a rolling direction.

$$F1=S_{<001>}/S_{<111>} \quad (iii)$$

If F1 described above is less than 5.0, it becomes difficult to make the <001> orientation, which is effective in improving the soft magnetic properties, develop sufficiently in the RD-direction crystal orientation. Therefore, F1 is preferably set to or more, preferably set to 10.0 or more. Although no particular upper limit value is specified on F1, F1 is usually 10000.0 or less.

Here, the grains having orientations parallel to the <001> direction refers to grains having crystal orientations that deviate from the <001> direction by 15° or less. The grains having orientations parallel to the <111> direction refers to grains having crystal orientations that deviate from the <111> direction by 15° or less.

$S_{<001>}$ and $S_{<111>}$ described above may be measured by the EBSD. The magnification is set to ×100, and two visual fields are selected. The visual fields are irradiated with electron beams at a step size (measurement pitch) of 0.5 μm, and an inverse pole FIGURE map is created. At this time, image analysis software is used to calculate $S_{<001>}$ and $S_{<111>}$.

4. Maximum Grain Size of Grains

By performing the adjustment annealing described later to control sizes of grains, the soft magnetic properties of the steel sheet can be further improved. Specifically, the control is preferably performed in such a manner as to make grain sizes coarse. The maximum grain size of grains observed is preferably 500 μm or more, and the maximum grain size is more preferably 1000 μm or more. Note that the average grain size of the grains observed is preferably 100 μm or more.

This is because, by controlling grains in such a manner that the grains have sizes within the range, crystal orientations can be controlled, and the value of F1 can be brought to within its preferable range. A maximum grain size is calculated by performing EBSD observation in which image analysis software is used to determine the largest value of sizes of grains that are calculated by equivalent circle approximation. Similarly, the average grain size is determined by calculating the average value of the sizes of the grains. Measurement conditions for the EBSD are the same as the conditions described above.

5. Sheet Thickness

From the viewpoint of processing, the ferritic stainless steel sheet in the present embodiment preferably has a sheet thickness of 3 mm or less, preferably 2 mm or less.

6. Production Method

A preferable method for producing the ferritic stainless steel sheet in the present embodiment will be described below.

6-1. Melting to Hot Rolling Step

A steel having the chemical composition described above is melted and cast by a conventional method, which produces a cast piece to be subjected to hot rolling. Next, the hot rolling is performed by a conventional method. Conditions for the hot rolling are not limited to particular conditions. However, it is usually preferable that a heating temperature of the cast piece is set to 1000 to 1300° C. and that a rolling reduction ratio is within the range of 90.0 to 99.9%. This hot rolling produces a hot-rolled sheet. After the hot rolling, pickling and hot-rolled sheet annealing are performed as necessary. Although the temperature of the hot-rolled sheet annealing is not limited to a particular temperature, the hot-rolled sheet annealing is usually performed within the range of 750 to 1100° C. The temperature is more preferably set to within the range of 850 to 950° C.

6-2. Cold Rolling Step

Subsequently, cold rolling is performed on the hot-rolled sheet subjected to the step described above, by which the hot-rolled sheet is formed into a cold-rolled sheet. In the cold rolling, rolls having diameters of 100 mm or less are preferably used. If rolls having diameters of more than 100 mm are used, shearing strain is unlikely to be introduced. This causes the <111> orientation to grow preferentially but prevents the <001> orientation from growing, in the RD-direction crystal orientation. As a result, the value of F1 is decreased, and the magnetized area fraction is also decreased. For that reason, the rolls having diameters of 100 mm or less are preferably used. Here, to bring the value of F1 to 5.0 or more and further increase the magnetized area fraction, a roll diameter of 90 mm or less is more preferably used, and a roll diameter of 80 mm or less is still more preferably used.

A reduction ratio for the cold rolling (referred to also as "cold rolling reduction rate") is preferably set to 75% or more. A cold rolling reduction rate of less than 75% is not a sufficient rolling reduction ratio, failing to give a desired sheet thickness. Further, the <001> orientation grows insufficiently, decreasing the value of F1, and thus the magnetized area fraction is decreased. For that reason, the cold rolling reduction rate is preferably set to 75% or more. To bring the value of F1 to 5.0 or more and further increase the magnetized area fraction, the cold rolling reduction rate is more preferably set to 80% or more. Still more preferably, the cold rolling reduction rate is set to 85% or more. Although no particular upper limit value is specified on the cold rolling reduction rate, the cold rolling reduction rate is usually 99% or less.

6-3. Cold-Rolled Sheet Annealing Step

Subsequently, after the cold rolling step, the cold-rolled sheet is subjected to annealing (hereinafter, referred to also as "cold-rolled sheet annealing"). In the cold-rolled sheet annealing, its annealing temperature and annealing time are not limited to a particular temperature and time. However, the annealing temperature is usually within the range of 800 to 1100° C., and the annealing time (retention duration) is usually within the range of 0 to 120 minutes. The other conditions may also be adjusted as appropriate, as necessary. After the cold-rolled sheet annealing, cooling to 300° C. is performed once. After the cold-rolled sheet annealing, pickling may be performed as necessary.

6-4. Adjustment Annealing Step

After the cold-rolled sheet annealing step, it is preferable to perform the adjustment annealing, which is for adjusting crystal orientations in the cold-rolled sheet, one or more times. This is because, by performing the adjustment annealing under appropriate conditions, the value of F1 can be further increased, and the value of the maximum grain size can be brought to 500 μm or more, which results in the improvement in the value of the magnetized area fraction.

The adjustment annealing includes additional annealing that is performed after the cold-rolled sheet annealing without processing and magnetic annealing that is performed after the cold-rolled sheet annealing and processing. In the adjustment annealing, only the additional annealing may be performed. The adjustment annealing may be performed twice, such as performing the additional annealing, the processing, and then the magnetic annealing. After the cold-rolled sheet annealing, only the magnetic annealing may be performed after the processing without the additional annealing. Performing the adjustment annealing usually causes the production of grains that are coarser than grains in the cold-rolled annealed steel sheet.

6-4-1. Annealing Atmosphere

In the adjustment annealing, an inert gas atmosphere or a vacuum atmosphere is preferably used as an annealing atmosphere. This is for preventing the surface of the steel sheet from being oxidized and for preventing the formation of oxides and nitrides on the surface of the steel sheet.

6-4-2. Annealing Temperature and Heating Rate

In the adjustment annealing, it is preferable to set the annealing temperature to within the range of more than 750° C. to 1350° C. or less and set the annealing time to within the range of 1 to 24 hours. If the annealing temperature is 750° C. or less, the <001> orientation grows insufficiently, and thus the value of F1 is decreased. Further, grains are unlikely to grow, resulting in a maximum grain size of less than 500 μm. Therefore, the annealing temperature is preferably set to more than 750° C., more preferably 900° C. or more. For the same reason, the annealing time is preferably set to 1 hour or more. To bring the magnetized area fraction to 70% or more, the annealing duration of the adjustment annealing is preferably set to 4 hours or more.

On the other hand, if the annealing temperature is more than 1350° C., recrystallization proceeds excessively, which results in a random micro-structure and is unlikely to produce a desired texture. There is also concern about degradation in the soft magnetic properties due to the production of martensite phases in the cooling process. Therefore, the annealing temperature is preferably set to 1350° C. or less, more preferably 1000° C. or less. In addition, performing annealing for a long time leads to a decrease in production efficiency, and thus the annealing duration is preferably set to 24 hours or less.

Here, it is preferable to set a heating rate for reaching the annealing temperature to less than 30° C./min. In a conventional production of a steel sheet, a high heating rate is typically used from the viewpoint of preventing grains from coarsening and the like. However, for the steel sheet in the present embodiment, a low heating rate is preferably used to perform heating slowly. This is because if a heating rate is 30° C./min or more, the heating proceeds rapidly, failing to allow the grains having the <001> orientation to grow. As a result, the value of F1 is decreased, making it difficult to improve the soft magnetic properties sufficiently, particularly to bring the magnetized area fraction to 70% or more. Therefore, the heating rate is preferably set to less than 30° C./min, more preferably 10° C./min or less.

Thereafter cooling is performed, thereby producing the steel sheet. At this time, the cooling and the like may be adjusted in such a manner that the micro-structure of the steel sheet becomes a micro-structure of a ferritic stainless steel sheet.

The present embodiment will be described below more specifically with Examples, but the present embodiment is not limited to these Examples.

EXAMPLE

Case pieces having chemical compositions shown in Table 1 were produced, and the resultant cast pieces were heated in a temperature range of 1200° C. and subjected to the hot rolling with a rolling reduction ratio of 90% or more, by which hot-rolled sheets were produced.

TABLE 1

| Chemical Composition (mass %, Balance: Fe and Impurities) | | | | | | | | | | |
|---|---|---|---|---|---|---|---|---|---|---|
| Steel No. | C | Si | Mn | S | P | Al | N | Cr | Mo | Ti |
| 1 | 0.005 | 0.08 | 0.20 | 0.0010 | 0.03 | 0.17 | 0.013 | 18.1 | 1.12 | 0.19 |
| 2 | 0.005 | 0.08 | 0.20 | 0.0010 | 0.03 | 0.17 | 0.013 | 18.1 | 1.12 | 0.33 |
| 3 | 0.006 | 0.08 | 0.20 | 0.0010 | 0.05 | 0.20 | 0.010 | 18.2 | 0.60 | 0.26 |
| 4 | 0.002 | 0.10 | 0.23 | 0.0004 | 0.01 | 0.18 | 0.006 | 18.4 | 1.12 | 0.06 |
| 5 | 0.008 | 0.18 | 0.21 | 0.0018 | 0.04 | 0.21 | 0.018 | 17.5 | 2.50 | 0.23 |
| 6 | 0.005 | 0.07 | 0.18 | 0.0012 | 0.02 | 0.10 | 0.013 | 18.3 | 1.23 | 0.23 |
| 7 | 0.006 | 0.03 | 0.41 | 0.0005 | 0.01 | 0.25 | 0.017 | 17.8 | 1.51 | 0.31 |
| 8 | 0.008 | 0.18 | 0.21 | 0.0018 | 0.04 | 0.21 | 0.018 | 17.5 | 2.50 | 0.45 |
| 9 | 0.005 | 0.08 | 0.20 | 0.0010 | 0.03 | 0.17 | 0.013 | 24.2 | 1.12 | 0.22 |
| 10 | 0.005 | 0.08 | 0.20 | 0.0010 | 0.03 | 0.17 | 0.015 | 15.1 | 2.01 | 0.22 |
| 11 | 0.009 | 0.12 | 0.19 | 0.0009 | 0.03 | 0.15 | 0.011 | 17.2 | 1.62 | — |
| 12 | 0.011 | 0.51 | 0.07 | 0.0026 | 0.04 | 0.42 | 0.021 | 16.8 | 1.87 | 0.20 |
| 13 | 0.009 | 1.52 | 0.23 | 0.0021 | 0.03 | 0.21 | 0.018 | 17.7 | 1.05 | 0.16 |
| 14 | 0.013 | 2.51 | 0.16 | 0.0015 | 0.04 | 0.22 | 0.015 | 17.5 | 1.25 | 0.16 |
| 15 | 0.004 | 0.08 | 0.34 | 0.0015 | 0.04 | 0.22 | 0.013 | 18.2 | 2.11 | 0.02 |
| 16 | 0.008 | 0.03 | 0.26 | 0.0016 | 0.03 | 0.21 | 0.015 | 18.3 | 0.02 ** | 0.22 |
| 17 | 0.007 | 0.04 | 0.28 | 0.0012 | 0.03 | 0.19 | 0.011 | 18.0 | 3.40 ** | 0.21 |
| 18 | 0.005 | 0.10 | 0.23 | 0.0018 | 0.02 | 0.23 | 0.013 | 11.2 ** | 1.49 | 0.25 |
| 19 | 0.018 ** | 0.12 | 0.24 | 0.0013 | 0.03 | 0.22 | 0.033 ** | 19.2 | 1.54 | 0.21 |
| 20 | 0.005 | 0.10 | 0.22 | 0.0041 ** | 0.09 ** | 0.15 | 0.015 | 17.2 | 1.11 | 0.18 |
| 21 | 0.005 | 0.11 | 1.12 ** | 0.0011 | 0.04 | 0.81 ** | 0.014 | 16.8 | 1.34 | 0.23 |
| 22 | 0.012 | 3.23 ** | 0.27 | 0.0014 | 0.02 | 0.24 | 0.016 | 18.3 | 1.37 | 0.27 |

| Steel No. | Nb | Ni | Cu | Zr | V | REM | B | Middle Value of Formula (i)† | Right Side Value of Formula (ii)†† |
|---|---|---|---|---|---|---|---|---|---|
| 1 | — | — | — | — | — | — | — | 0.19 | 22.0 |
| 2 | — | 0.45 | 0.08 | — | — | — | — | 0.33 | 22.0 |
| 3 | — | 0.06 | 0.02 | — | — | — | — | 0.26 | 20.3 |
| 4 | 0.04 | 0.30 | 0.05 | — | — | — | — | 0.10 | 22.2 |
| 5 | 0.21 | 0.35 | 0.05 | — | — | — | — | 0.44 | 26.0 |
| 6 | — | 0.20 | 0.04 | 0.01 | 0.01 | — | — | 0.23 | 22.6 |
| 7 | — | 0.21 | 0.03 | 0.02 | — | 0.01 | — | 0.31 | 23.1 |
| 8 | — | 0.35 | 0.05 | — | — | — | — | 0.45 | 26.0 |
| 9 | — | — | — | — | — | — | — | 0.22 | 28.1 |
| 10 | — | — | — | — | — | — | — | 0.22 | 22.0 |
| 11 | 0.19 | — | — | — | — | — | — | 0.19 | 22.7 |
| 12 | — | — | — | — | — | — | 0.002 | 0.20 | 23.3 |
| 13 | — | — | — | — | — | — | — | 0.16 | 21.5 |
| 14 | — | — | — | — | — | — | — | 0.16 | 21.9 |
| 15 | — | 0.23 | 0.08 | — | — | — | — | 0.02 ** | 25.4 |
| 16 | — | 0.12 | 0.03 | — | — | — | — | 0.22 | 18.6 ** |
| 17 | — | 0.21 | 0.04 | — | — | — | — | 0.21 | 29.4 |
| 18 | — | 0.33 | 0.05 | — | — | — | — | 0.25 | 16.3 ** |

TABLE 1-continued

| Chemical Composition (mass %, Balance: Fe and Impurities) | | | | | | | | | |
|---|---|---|---|---|---|---|---|---|---|
| 19 | — | — | — | — | — | — | — | 0.21 | 24.8 |
| 20 | — | — | — | — | — | — | — | 0.18 | 21.1 |
| 21 | — | — | — | — | — | — | — | 0.23 | 21.4 |
| 22 | — | — | — | — | — | — | — | 0.27 | 23.1 |

†0.10 ≤ Ti + Nb ≤ 0.50 . . . (i)

††PREN = Cr + 3.3 Mo + 16N . . . (ii)

The mark "** " indicates that the value with the mark fell out of the range defined in dependent claims of the present embodiment.

After the hot rolling, the hot-rolled sheet annealing was performed at 975° C., and then pickling and the like were performed. Subsequently, the cold rolling was performed with roll diameters and rolling reduction ratio adjusted under conditions shown in Table 2, the cold-rolled sheet annealing was then performed at 920° C. for 1 minute, the pickling was performed, and the cooling was performed, by which ferritic stainless steel sheets were produced. In some examples, the adjustment annealing (additional annealing) was further performed under conditions shown in Table 2 in addition to the cold-rolled sheet annealing and the like, and the cooling was performed in such a manner as to produce ferritic stainless steel sheets, by which steel sheets were produced. The annealing atmosphere for the adjustment annealing (additional annealing) was vacuum.

TABLE 2

| | | Hot-Rolled | Cold Rolling | | | Cold-Rolled | | | |
|---|---|---|---|---|---|---|---|---|---|
| | | Sheet Annealing | | Cold Rolling | Sheet Thickness | Sheet Annealing | Adjustment Annealing (Additional Annealing) | | |
| Test No. | Steel type | Annealing Temperature (° C.) | Roll Diameter (mm) | Reduction Rate (%) | after Rolling (mm) | Annealing Temperature (° C.) | Heating Rate (° C./min) | Annealing Temperature (° C.) | Annealing Time (h) |
| 1 | 1 | 975 | 75 | 90 | 0.5 | 920 | — | — | — |
| 2 | 1 | 975 | 75 | 90 | 0.5 | 920 | 10 | 950 | 24 |
| 3 | 2 | 975 | 75 | 90 | 0.5 | 920 | — | — | — |
| 4 | 2 | 975 | 75 | 90 | 0.5 | 920 | 10 | 950 | 24 |
| 5 | 3 | 975 | 75 | 90 | 0.5 | 920 | — | — | — |
| 6 | 4 | 975 | 75 | 90 | 0.5 | 920 | — | — | — |
| 7 | 5 | 975 | 75 | 90 | 0,5 | 920 | — | — | — |
| 8 | 6 | 975 | 75 | 90 | 0.5 | 920 | — | — | — |
| 9 | 7 | 975 | 75 | 90 | 0.5 | 920 | — | — | — |
| 10 | 2 | 975 | 75 | 90 | 0.5 | 920 | 30 | 950 | 24 |
| 11 | 2 | 975 | 75 | 90 | 0.5 | 920 | 10 | 750 | 24 |
| 12 | 2 | 975 | 75 | 75 | 1.0 | 920 | 10 | 950 | 24 |
| 13 | 2 | 975 | 100 | 90 | 0.5 | 920 | 10 | 950 | 24 |
| 14 | 2 | 975 | 75 | 80 | 0.8 | 920 | 10 | 950 | 24 |
| 15 | 2 | 975 | 75 | 80 | 0.8 | 920 | 10 | 900 | 24 |
| 16 | 8 | 975 | 75 | 90 | 0.5 | 920 | — | — | — |
| 17 | 9 | 975 | 75 | 90 | 0.5 | 920 | — | — | — |
| 18 | 10 | 975 | 75 | 90 | 0.5 | 920 | — | — | — |
| 19 | 11 | 975 | 75 | 90 | 0.5 | 920 | — | — | — |
| 20 | 12 | 975 | 75 | 90 | 0.5 | 920 | — | — | — |
| 21 | 13 | 975 | 75 | 90 | 0.5 | 920 | — | — | — |
| 22 | 14 | 975 | 75 | 90 | 0.5 | 920 | — | — | — |
| 23 | 2 | 975 | 75 | 90 | 0.5 | 920 | 10 | 950 | 2 |
| 24 | 15 ** | 975 | 75 | 90 | 0.5 | 920 | — | — | — |
| 25 | 16 ** | 975 | 75 | 90 | 0.5 | 920 | — | — | — |
| 26 | 17 ** | 975 | 75 | 90 | 0.5 | 920 | — | — | — |
| 27 | 18 ** | 975 | 75 | 90 | 0.5 | 920 | — | — | — |
| 28 | 19 ** | 975 | 75 | 90 | 0.5 | 920 | — | — | — |
| 29 | 20 ** | 975 | 75 | 90 | 0.5 | 920 | — | — | — |
| 30 | 21 ** | 975 | 75 | 90 | 0.5 | 920 | — | — | — |
| 31 | 22 ** | 975 | 75 | 90 | 0.5 | 920 | — | — | — |
| 32 | 2 | 975 | 200 | 65 | 1.0 | 920 | — | — | — |
| 33 | 2 | 975 | 75 | 65 | 1.5 | 920 | 10 | 950 | 24 |
| 34 | 2 | 975 | 200 | 90 | 0.5 | 920 | 10 | 950 | 24 |
| 35 | 14 | 975 | 200 | 65 | 1.0 | 920 | — | — | — |

The underline indicates that the underlined value fell out of the corresponding production condition defined in the present invention.

The mark "**" indicates that the value with the mark is out of a range defined in dependent claims of the present invention.

The resultant steel sheets were examined in the magnetized area fraction, the crystal orientation, and the sizes of grains (the maximum grain size and the average grain size). In addition, to evaluate properties, the measurement of magnetic flux density and a salt spray test were conducted. The measurements and the test were conducted by the following procedure.

(Magnetized Area Fraction)

A magnetic domain observation microscope used for measuring the magnetized area fraction was Neomagnesia Lite from NEOARK Corporation, which included a white LED as the light source and a Weiss electromagnet as the electromagnet. First, an amount of change in reflection light intensity was measured in the state where no magnetic field is applied to a sample, and a case where 99% of an observation region was umnagnetized was examined. Subsequently, with a magnetic field of 1000 Oe applied to the sample, a region having an amount of change in reflection light intensity exceeding the specified threshold was extracted as a magnetized region, and the magnetized area fraction was calculated. Here, an exterior magnetic field was applied in the rolling direction. The threshold may be specified as a given intensity selected from contrast intensities of an observed image before and after the application of the magnetic field. In this case, a contrast intensity serving as the threshold was specified in such a manner that 99% of the observation region observed before the application of the magnetic field was included as being in an unmagnetized state. The observation was performed in three visual fields with a magnification within the range of ×1000 to ×2500.

(Crystal Orientation)

The crystal orientation was measured by the EBSD. A rolled surface after thickness reduction to a sheet thickness center was used as an observation surface, a magnification was set to ×100, and two visual fields were selected as measurement fields. The visual fields were irradiated with electron beams at a step size (measurement pitch) of 0.5 μm, and an inverse pole FIGURE map was created. At this time, image analysis software was used to calculate $S_{<001>}$ and $S_{<111>}$.

(Maximum Grain Size and Average Grain Size)

A maximum grain size was calculated by performing the EBSD in which an L-section of each steel sheet was observed, and image analysis software was used to determine the largest value of sizes of grains that were calculated by equivalent circle approximation. Similarly, the average grain size was determined by calculating the average value of the sizes of the grains. Measurement conditions for the EBSD were the same as the conditions described above. In examples in which the additional annealing was not performed, the maximum grain sizes and the average grain sizes of steel sheets that were produced through the step without the additional annealing were measured by the EBSD. Similarly, in examples in which the additional annealing was performed, the maximum grain sizes and the average grain sizes of steel sheets that were produced through the additional annealing were measured by the EBSD.

(Measurement of Magnetic Flux Density)

As the magnetic flux density, a ring test using a B-H tracker was conducted, and the value of a magnetic flux density $B_5$ was measured. A case where the magnetic flux density was 0.40 T or more was evaluated as being satisfactory in the magnetic flux density, and a case where the magnetic flux density was less than 0.40 was evaluated as being poor in the magnetic flux density.

(Salt Spray Test)

The salt spray test was conducted based on JIS Z 2371: 2015. Specifically, samples were cut from the resultant steel sheets, and salt water was sprayed on the surfaces of the samples. After 24 hours from the spraying, the surfaces of the samples were visually observed for the occurrence of rust. In Table 3, samples having no rust were rated as A, samples having a few rust spots and having a rusting area of less than 10% were rated as B, and samples having a rusting area of 10% or more were rated as C. Samples with a surface state was more satisfactory than A was rated as E.

The samples used in the measurements and the test were taken from a center portion in a width direction, which has a normal metal micro-structure. Results are collectively shown in Table 3 below.

TABLE 3

| | | Steel Sheet Material | | | Property Evaluation | | | |
|---|---|---|---|---|---|---|---|---|
| | | | | | Magnetic | | | |
| Test No. | Steel type | F1 | Grain Diameter (μm) Maximum Grain Size | Grain Diameter (μm) Average Grain Size | Magnetization Area Fraction (%) | Flux Density $B_5$ (T) | Salt Spray Test | |
| 1 | 1 | 6.0 | <100 ** | 60 | 55 | 0.69 | A | Inventive |
| 2 | 1 | 11.0 | 1150 | ≥100 | 90 | 1.12 | A | Example |
| 3 | 2 | 6.5 | <100 ** | 50 | 50 | 0.75 | A | |
| 4 | 2 | 10.0 | 1100 | ≥100 | 90 | 1.15 | A | |
| 5 | 3 | 6.0 | <100 ** | 60 | 50 | 0.71 | B | |
| 6 | 4 | 5.5 | <100 ** | 70 | 65 | 0.79 | A | |
| 7 | 5 | 6.5 | <100 ** | 50 | 60 | 0.76 | A | |
| 8 | 6 | 5.0 | <100 ** | 55 | 50 | 0.73 | A | |
| 9 | 7 | 6.0 | <100 ** | 60 | 55 | 0.66 | A | |
| 10 | 2 | 5.5 | 950 | ≥100 | 60 | 0.79 | A | |
| 11 | 2 | 6.5 | 600 | ≥100 | 65 | 0.64 | A | |
| 12 | 2 | 4.0 ** | 900 | ≥100 | 60 | 0.70 | A | |
| 13 | 2 | 4.5 ** | 950 | ≥100 | 65 | 0.74 | A | |
| 14 | 2 | 8.5 | 850 | ≥100 | 85 | 0.98 | A | |
| 15 | 2 | 8.0 | 750 | ≥100 | 75 | 0.94 | A | |
| 16 | 8 | 6.5 | <100 ** | 60 | 55 | 0.52 | A | |
| 17 | 9 | 5.0 | <100 ** | 50 | 55 | 0.59 | A | |
| 18 | 10 | 5.5 | <100 ** | 70 | 55 | 0.55 | A | |
| 19 | 11 | 6.0 | <100 ** | 55 | 50 | 0.62 | A | |
| 20 | 12 | 5.5 | <100 ** | 50 | 50 | 0.69 | A | |
| 21 | 13 | 5.5 | <100 ** | 45 | 55 | 0.77 | A | |
| 22 | 14 | 5.0 | <100 ** | 40 | 50 | 0.84 | A | |
| 23 | 2 | 7.0 | 343 | 65 | 65 | 0.78 | A | |
| 24 | 15 ** | 4.5 ** | <200 ** | 100 | 45 * | 0.39 | A | Comparative |
| 25 | 16 ** | 7.5 | <100 ** | 70 | 45 * | 0.38 | C | Example |
| 26 | 17 ** | 6.0 | <100 ** | 50 | 40 * | 0.36 | A | |

TABLE 3-continued

| Test No. | Steel type | Steel Sheet Material: F1 | Grain Diameter (μm) Maximum Grain Size | Grain Diameter (μm) Average Grain Size | Property Evaluation: Magnetic: Magnetization Area Fraction (%) | Flux Density $B_5$ (T) | Salt Spray Test |
|---|---|---|---|---|---|---|---|
| 27 | 18 ** | 3.0 ** | <100 ** | 80 | 45 * | 0.35 | C |
| 28 | 19 ** | 3.5 ** | <100 ** | 40 | 30 * | 0.32 | A |
| 29 | 20 ** | 3.5 ** | <100 ** | 40 | 35 * | 0.34 | B |
| 30 | 21 ** | 5.5 | <100 ** | 45 | 45 * | 0.36 | E |
| 31 | 22 ** | 4.5 ** | <100 ** | 35 | 40 * | 0.35 | E |
| 32 | 2 | 4.5 ** | <100 ** | 30 | 30 * | 0.32 | A |
| 33 | 2 | 4.0 ** | 1000 | ≥100 | 45 * | 0.36 | A |
| 34 | 2 | 4.0 ** | 950 | ≥100 | 40 * | 0.35 | A |
| 35 | 14 | 3.5 | <100 ** | 50 | 45 * | 0.51 | A |

The mark "*" indicates that the value with the mark fell out of the regulation according to the present invention.
The mark "**" indicates that the value with the mark is out of a range defined in dependent claims of the present invention.
The underline indicates that the underlined value fell out of its targeted property value.

In Nos. 1 to 23, which satisfied the requirements of the present embodiment, their magnetic flux densities were satisfactory and corrosion resistances were satisfactory because no rusting was observed. In contrast, in Nos. 24 to 35, which did not satisfy the requirements of the present embodiment, at least one of their soft magnetic properties and corrosion resistances were poor, such as a low magnetized area fraction, a poor magnetic flux density, and rusting observed.

Of the examples, in Nos. 2, 4, 14, and 15, the additional annealing was performed, and production conditions that were more preferable than those of the present embodiment were satisfied. As a result, their values of F1 were 5.0 or more, and their magnetized area fractions were 70% or more, showing the most satisfactory soft magnetic properties.

In contrast, in No. 10, its heating rate of the additional annealing was a little high. As a result, its value of F1 was slightly decreased, and thus its soft magnetic properties were degraded compared with the examples of Nos. 2, 4, 14, and 15. In No. 11, its annealing temperature of the additional annealing was a little low. As a result, its maximum grain size was decreased, and thus its soft magnetic properties were degraded compared with the examples of Nos. 2, 4, 14, and 15. In No. 12, its rolling reduction ratio of the cold rolling was a little low. As a result, its value of F1 was slightly decreased, and thus its soft magnetic properties were degraded compared with the examples of Nos. 2, 4, 14, and 15. Likewise, in No. 13, its roll diameter in the cold rolling was a little large. As a result, its value of F1 was slightly decreased, and thus its soft magnetic properties were degraded compared with the examples of Nos. 2, 4, 14, and 15. In No. 22, its content of Si was high. As a result, although its magnetic flux density was increased, its magnetized area fraction was decreased.

For example, in comparison between examples in which the additional annealing was performed under preferable conditions and examples in which the additional annealing was not performed, such as between No. 1 and No. 2, and No. 3 and No. 4, the examples in which the additional annealing was performed under preferable conditions increased the value of F1 and improved the soft magnetic properties. In No. 23, its annealing duration of the additional annealing was less than 4 hours. As a result, its magnetized area fraction was less than 70%.

Of comparative examples, Nos. 24 to 31 each having a chemical composition that did not satisfy preferable requirements of the present embodiment failed to satisfy the requirement of the magnetized area fraction, and their soft magnetic properties were degraded. In No. 32, its roll diameter in the cold rolling was large, and its rolling reduction ratio was low. As a result, it failed to satisfy the requirement of the magnetized area fraction, and its soft magnetic properties were degraded. Further, its value of F1 was also decreased. In No. 33, its rolling reduction ratio of the cold rolling was low. As a result, its magnetized area fraction was low despite the additional annealing performed, and its soft magnetic properties were degraded. Further, its value of F1 was also decreased. In No. 34, its roll diameter in the cold rolling was large. As a result, its magnetized area fraction was low despite the additional annealing performed, and its soft magnetic properties were degraded. Further, its value of F1 was also decreased. In No. 35, its roll diameter in the cold rolling was large. As a result, although its value of the magnetic flux density was relatively satisfactory, its magnetized area fraction was decreased.

The invention claimed is:

1. A ferritic stainless steel sheet, wherein
a chemical composition consists of, in mass %:
C: 0.015% or less,
Si: 3.0% or less,
Mn: 1.0% or less,
S: 0.0040% or less,
P: 0.08% or less,
Al: 0.80% or less,
N: 0.030% or less,
Cr: 15.0 to 25.0%,
Mo: 0.5 to 3.0%,
Ti: 0 to 0.50%,
Nb: 0 to 0.50%,
Ni: 0 to 0.50%,
Cu: 0% or more to less than 0.1%,
Zr: 0 to 1.0%,
V: 0 to 1.0%,
REM: 0 to 0.05%, and
B: 0 to 0.01%,
with the balance: Fe and impurities, and
satisfies Formula (i) shown below:

$$0.10 \leq Ti+Nb \leq 0.50 \quad \text{(i)}$$

where symbols of elements in the formula indicate contents (mass %) of the elements contained in the steel, and when an element is not contained, zero will be set to the corresponding symbol;

a maximum grain size of grains is 343 μm or more; and the ferritic stainless steel sheet comprises a magnetized area fraction of 70% or more, wherein the magnetized area fraction is an area fraction of a magnetized region, the magnetized region being determined by the following steps using a magnetic domain observation microscope:

(a) an amount of change in reflection light intensity is measured in a state where no magnetic field is applied to a sample, and a threshold is specified for an amount of change in reflection light intensity with which 99% of an observation region is determined to be unmagnetized;

(b) with a magnetic field of 1000 Oe applied to the sample, a region having an amount of change in reflection light intensity exceeding the specified threshold of step (a) is extracted as a magnetized region; and (c) the observation is performed in three visual fields with a magnification within a range of x1000 to x2500, and in a rolling direction crystal orientation, F1 that is given by Formula (iii) shown below and is a ratio between a total area $S_{<00>}$ of grains having orientations parallel to a <001> direction and a total area $S_{111>}$ of grains having orientations parallel to a <111> direction is 5.0 or more:

$$F1=S_{<001>}/S_{<111>} \quad \text{(iii)}$$

2. The ferritic stainless steel sheet according to claim 1, wherein the chemical composition contains, in mass %, Si: 0.60% or less.

3. The ferritic stainless steel sheet according to claim 1, wherein the chemical composition contains one or more elements selected from, in mass %:

Ni: 0.05 to 0.50%,

Cu: 0.01% or more to less than 0.1%,

Zr: 0.01 to 1.0%,

V: 0.01 to 1.0%,

REM: 0.005 to 0.05%, and

B: 0.0002 to 0.01%.

4. The ferritic stainless steel sheet according to claim 1, wherein a pitting resistance equivalent number PREN that is calculated by Formula (ii) shown below is 20.0 or more:

$$PREN=Cr+3.3Mo+16N \quad \text{(ii)}$$

where symbols of elements in Formula (ii) shown above indicate contents (mass %) of the elements contained in the steel, and when an element is not contained, zero will be set to the corresponding symbol.

5. The ferritic stainless steel sheet according to claim 1, wherein a maximum grain size of grains observed is 500 μm or more.

6. The ferritic stainless steel sheet according to claim 2, wherein the chemical composition contains one or more elements selected from, in mass %:

Ni: 0.05 to 0.50%,

Cu: 0.01% or more to less than 0.1%,

Zr: 0.01 to 1.0%,

V: 0.01 to 1.0%,

REM: 0.005 to 0.05%, and

B: 0.0002 to 0.01%.

7. The ferritic stainless steel sheet according to claim 2, wherein a pitting resistance equivalent number PREN that is calculated by Formula (ii) shown below is 20.0 or more:

$$PREN=Cr+3.3Mo+16N \quad \text{(ii)}$$

where symbols of elements in Formula (ii) shown above indicate contents (mass %) of the elements contained in the steel, and when an element is not contained, zero will be set to the corresponding symbol.

8. The ferritic stainless steel sheet according to claim 3, wherein a pitting resistance equivalent number PREN that is calculated by Formula (ii) shown below is 20.0 or more:

$$PREN=Cr+3.3Mo+16N \quad \text{(ii)}$$

where symbols of elements in Formula (ii) shown above indicate contents (mass %) of the elements contained in the steel, and when an element is not contained, zero will be set to the corresponding symbol.

9. The ferritic stainless steel sheet according to claim 6, wherein a pitting resistance equivalent number PREN that is calculated by Formula (ii) shown below is 20.0 or more:

$$PREN=Cr+3.3Mo+16N \quad \text{(ii)}$$

where symbols of elements in Formula (ii) shown above indicate contents (mass %) of the elements contained in the steel, and when an element is not contained, zero will be set to the corresponding symbol.

* * * * *